United States Patent [19]

Yamada et al.

[11] Patent Number: 5,057,027

[45] Date of Patent: Oct. 15, 1991

[54] FEMALE TERMINAL FOR AN ELECTRICAL CONNECTOR

[75] Inventors: Shoji Yamada, Mashida; Masami Sasao, Kawasaki, both of Japan

[73] Assignee: Molex Incorporated, Lisle, Ill.

[21] Appl. No.: 667,791

[22] Filed: Mar. 11, 1991

[30] Foreign Application Priority Data

Mar. 20, 1990 [JP] Japan ..... 2-28996[U]

[51] Int. Cl.[5] ..... H01R 9/09

[52] U.S. Cl. ..... 439/83; 439/885

[58] Field of Search ..... 439/80–83, 439/885

[56] References Cited

U.S. PATENT DOCUMENTS 4,955,820 9/1990 Yamada et al. ..... 439/83

4,992,056 2/1991 Douty et al. ..... 439/83

*Primary Examiner*—Paula A. Bradley

*Attorney, Agent, or Firm*—Louis A. Hecht; A. A. Tirva; Stephen Z. Weiss

[57] ABSTRACT

An improved female terminal for an electrical connector wherein the female terminal includes a T-shaped soldering foot, a contact section and a mounting section integrally connected together and stamped out from a metal strip. The contact section and mounting section are linearly contiguous, and the T-shaped soldering foot extends from the mounting section. Each female terminal in a consecutive series of female terminals is integrally connected to a longitudinal carrier strip and has the T-shaped soldering foot and contact section bent to opposite sides of the mounting section. All the female terminals may be inserted in the slots of the female terminal housing simultaneously.

9 Claims, 4 Drawing Sheets

FEMALE TERMINAL FOR AN ELECTRICAL CONNECTOR

FIELD OF THE INVENTION

The present invention relates to terminals for electrical connectors interconnecting printed circuit boards, and more particularly to the shape of female terminals located in such connectors.

BACKGROUND OF THE INVENTION

A variety of electrical connectors, each comprising a male plug and a female receptacle are known in the art for establishing electrical connections between conductors located on different printed circuit boards or discrete conductors terminated to the connectors. The female receptacle has a housing with a plurality of female terminals laterally arranged at regular intervals and inserted in slots located in the female housing. Likewise, the male plug has a housing with a plurality of male terminals laterally arranged at regular intervals and inserted in slots located in the male housing. When the male and female portions are mated together, an electrical connection is established between circuits on printed circuit boards or discrete conductors connected to the male and female terminals of the electric connector.

A number of prior art stamped female terminals is shown in FIG. 7. A female terminal 5' has a T shaped soldering foot 5*a'* on one side, a contact section 5*b'*, for engaging a male terminal 6, on the other side, and a mounting section 5*c'* integrally connected both to the T shaped soldering foot 5*a'* and the contact section 5*b'* for mounting the female terminal 5' in the female housing 1. The female terminal shape may be stamped out from a metal strip, and the terminal is then used as is without requiring any secondary manufacturing operations to be performed on it. The T-shaped soldering foot 5*a'* of the female terminal 5' resists forces trying to pull the female terminal from the printed circuit board during the disengagement of the male housing from the female housing. As shown in FIG. 7, the die-cut surfaces of the punched female terminal are used as contact surfaces. The length of the terminal portion joining the T-shape soldering foot 5*a'* and the contact section 5*b'* is designed to be long enough to make the contact section 5*b'* resilient. Accordingly, the joining portion is relatively long and it increases the lateral width of the terminal.

The prior art female terminal shape has the following disadvantages:

1) As shown in FIG. 7, the female terminal shape has a relatively long lateral extension L, spanning the distance from the upright contact section 5*b'* to the T-shaped soldering foot 5*a'* from one side to the terminal to the other side of the terminal.

The female terminal shapes to be punched from a given metal strip are limited to a relatively small number because of the relatively long lateral extension of each female terminal shape.

2) All the female terminals have to be separated from the longitudinal carrier strip 11 prior to insertion, and therefore are inserted individually one after another in the slots of the female housing. This is a time consuming and tedious work.

3) Each female terminal contacts a mating male terminal by its narrow die-cut surface rather than its uncut smooth surface. It is difficult to make the die-cut surface as smooth as the top or bottom of the metal piece even if the die-cut surface is subjected to finishing operations, and accordingly it is difficult to establish a good electrical contact between the surface contact areas of the mating terminals.

SUMMARY OF INVENTION

One object of the present invention is to provide a female terminal having a shape which permits an increased number of female terminals to be punched out from a given length of metal strip.

Another object of the present invention is to provide a female terminal having a shape which permits simultaneous insertion of a contiguous series of female terminals in corresponding slots of the female housing prior to separation of the terminals from the longitudinal carrier strip.

Still another object of the present invention is to provide a female terminal having a shape wherein its contact surface ensures a good electrical contact with a mating male terminal.

To attain these objects a female terminal is provided for insertion into a selected slot of a female terminal housing of an electrical connector, comprising a T-shaped soldering foot, a contact section for contacting in a mating male terminal and a mounting section integrally connected both to the T-shaped soldering foot and the contact section to retain the female terminal in the female terminal housing. The female terminal has a shape wherein the T-shaped soldering foot, the contact section and the mounting section are integrally connected and the entire terminal is stamped out of a metal strip. The contact and the mounting sections are linearly contiguous and the T-shaped soldering foot extends from the mounting section. The T-shaped soldering foot is bent perpendicular to one major surface of the mounting section, and the contact section is bent and formed to face the other major surface of the mounting section.

The contact section is formed in a "U"-shape to face the other major surface of the mounting section, the horizontal length of the "U" shaped section being relatively long.

The mating male terminal, which the contact section of the female terminal is designed to contact, is soldered to a given printed circuit board.

The contact section of the female terminal is linearly contiguous to the mounting section, and the T-shaped soldering foot extends from the mounting section. The T-shaped soldering foot is bent perpendicular to one major plane of the mounting section whereas the contact section is bent and formed in the direction which is opposite to the direction in which the T-shape soldering foot is bent. The contact section thus faces the other major plane of the mounting section. The lateral size "l" of the female terminal is relatively small, and accordingly an increased number of female terminals may be punched out from a given length of metal strip.

The T-shaped soldering foot and contact section of each female terminal may be bent in opposite directions without separating the female terminal shape from the longitudinal carrier strip, and all the female terminals thus bent remain in the same arrangement as they are when inserted in the slots of the female housing. Therefore, a contiguous series of female terminals may be nested within the female housing before they are separated from the longitudinal carrier strip. Thus, the time consuming and tedious work of inserting female terminals individually one after another in selected slots of the female housing is not necessary.

Also, advantageously a major plane of the contact section may be used as contact surface for a mating male terminal, ensuring that good electrical contact is established between the male and female terminals.

Other objects and advantages of the present invention will be understood from the following description of the female terminal according to one embodiment of the present invention, which is shown in the accompanying drawings.

DETAILED DESCRIPTION

Figure 1:
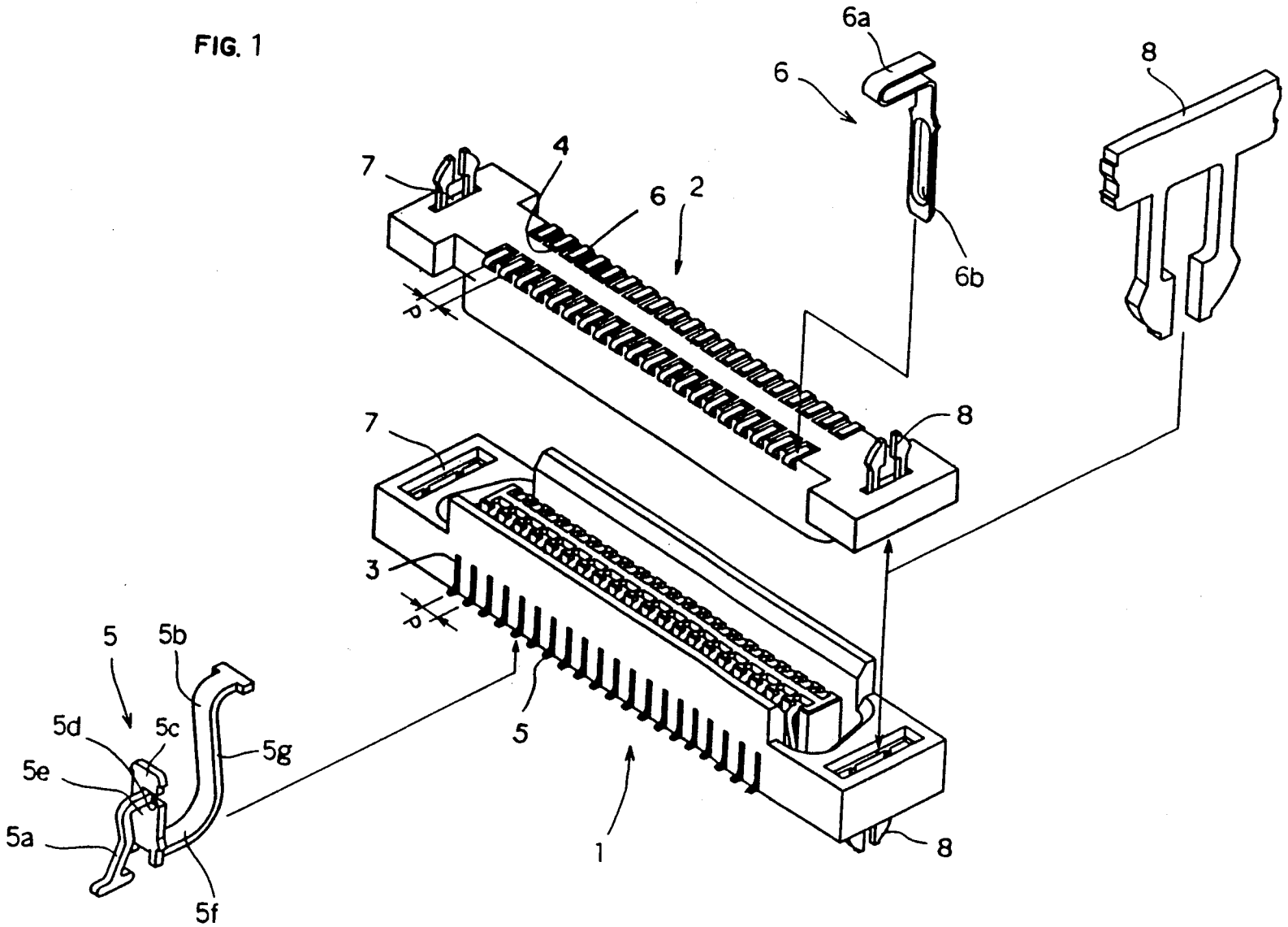
FIG. 1 is a perspective view of a female terminal according to the present invention along with the female and male housings and a mating male terminal.

Referring to FIGS. 1 to 6, a female terminal housing 1 has a plurality of insertion slots 3 located at regular intervals or pitch P to accommodate female terminals 5. Female terminal housing has peg insertion slots 7 at its opposite ends. As shown in FIG. 1, pegs 8 are inserted in peg insertion slots 7. Female terminal housing 1 may be attached to a printed circuit board 9 by inserting pegs 8 into mounting holes (not shown) of printed board 9. The T-shaped soldering foot 5*a* of each female terminal 5 is soldered to selected conductors (not shown) of the printed circuit of printed board 9.

Male terminal housing 2, has a plurality of male terminal insertion slots 4 located at the same pitch as female terminal insertion slots 3 of female terminal housing 1. Each insertion slot 4 accommodates a male terminal 6. As shown in FIG. 1, pegs 8 are inserted in peg insertion slots 7. Male terminal housing 2 may be attached to a printed circuit board 10 by inserting its pegs 8 into mounting holes (not shown) of printed board 10. The T-shaped soldering foot 6*a* of each male terminal 6 is soldered to selected conductors (not shown) of the printed circuit of printed board 10. Male terminals 6 may be soldered to discrete conductors instead of conductors on printed board 10.

When all male terminals 6 of the male housing 2 are mated with corresponding female terminals 5 of the female housing contact sections 6*b* of all male terminals 6 will contact corresponding contact sections 5*b* of the female terminals 5, establishing the desired electrical connections between printed boards 9 and 10.

Figure 3:
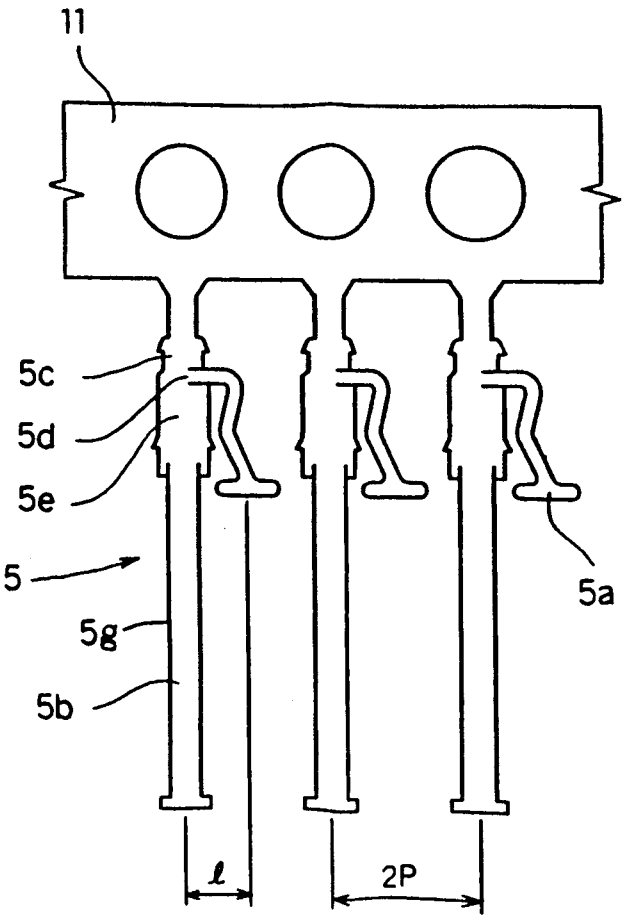
FIG. 3 is a section of a contiguous series of female terminals prior to separation from the longitudinal carrier strip.
Figure 2:
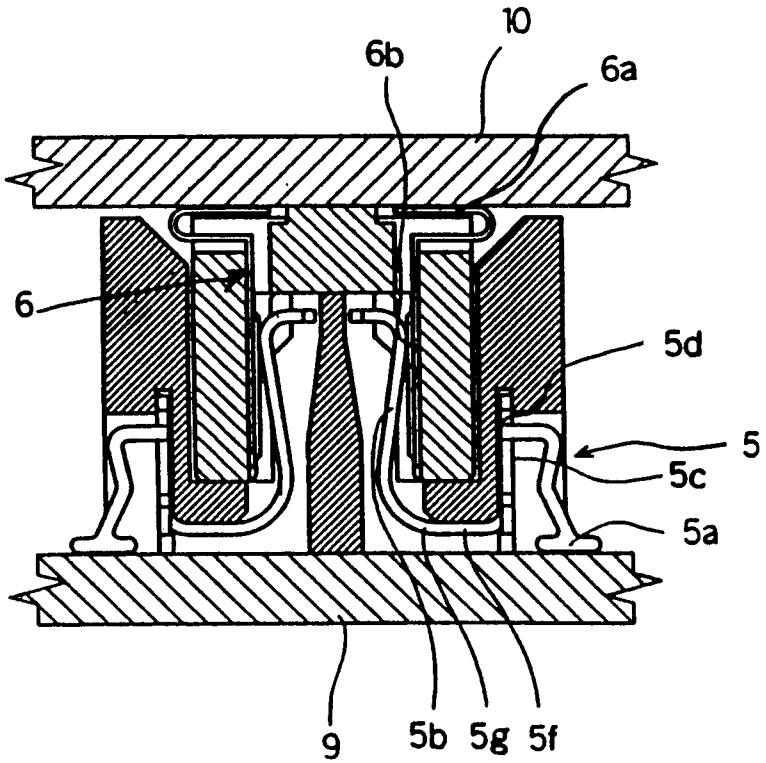
FIG. 2 is a cross sectional view showing the mated male and female portions of the electrical connector.
Figure 5:
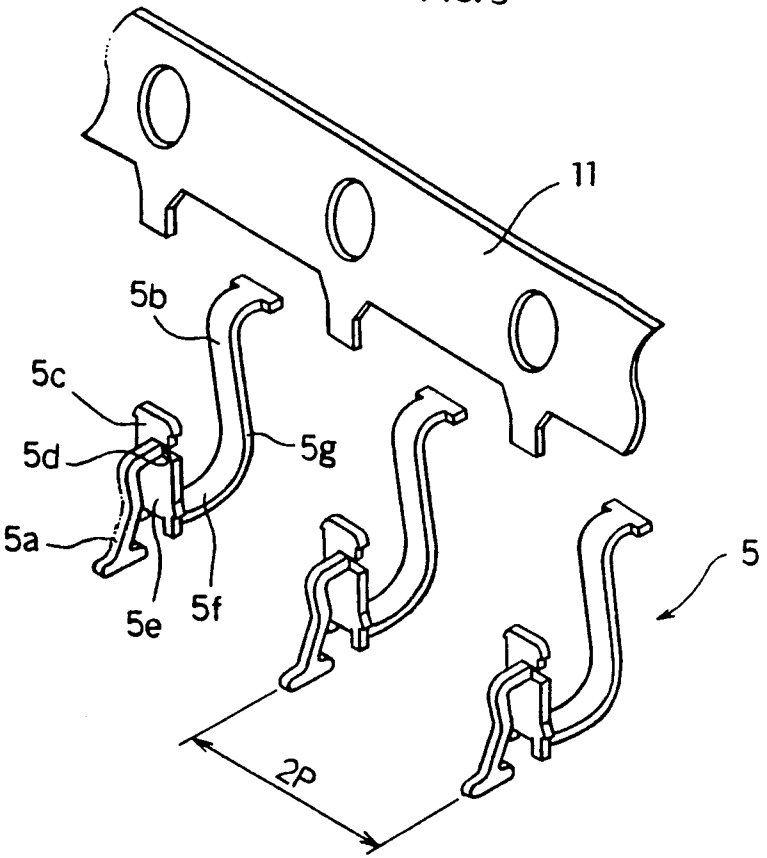
FIG. 5 is perspective view of the sectional female terminals (shown in FIG. 3) each having its contact section bent in opposite directions, the female terminals ready for insertion into the female housing.
Figure 4:
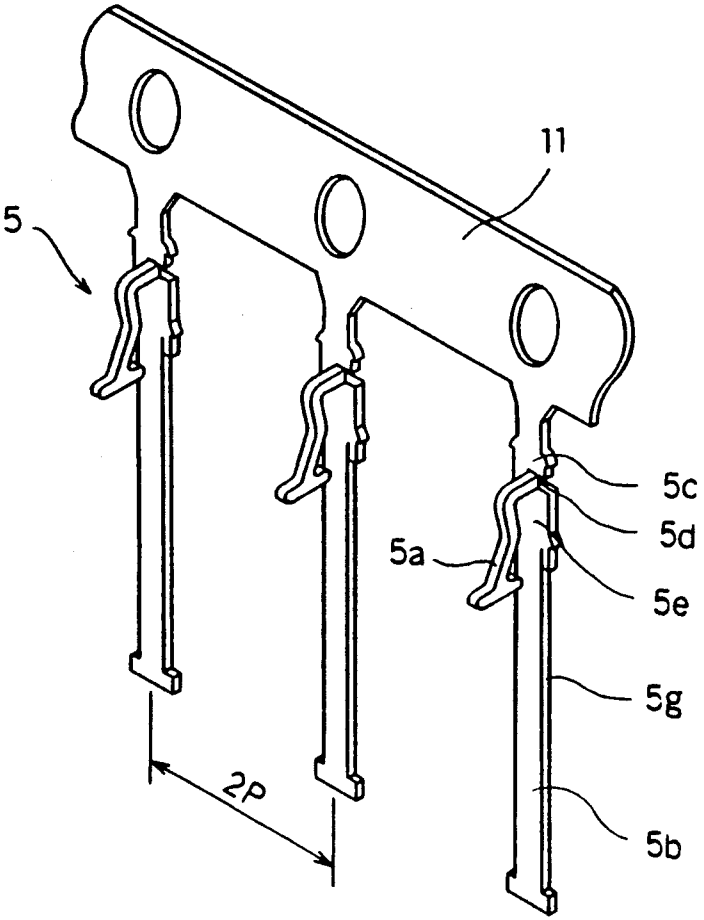
FIG. 4 is a perspective view of the section of the contiguous series of female terminals (shown in FIG. 3), each having its T-shaped foot bent perpendicular to the major surface of the mounting section prior to separation from the longitudinal carrier strip.
Figure 7:
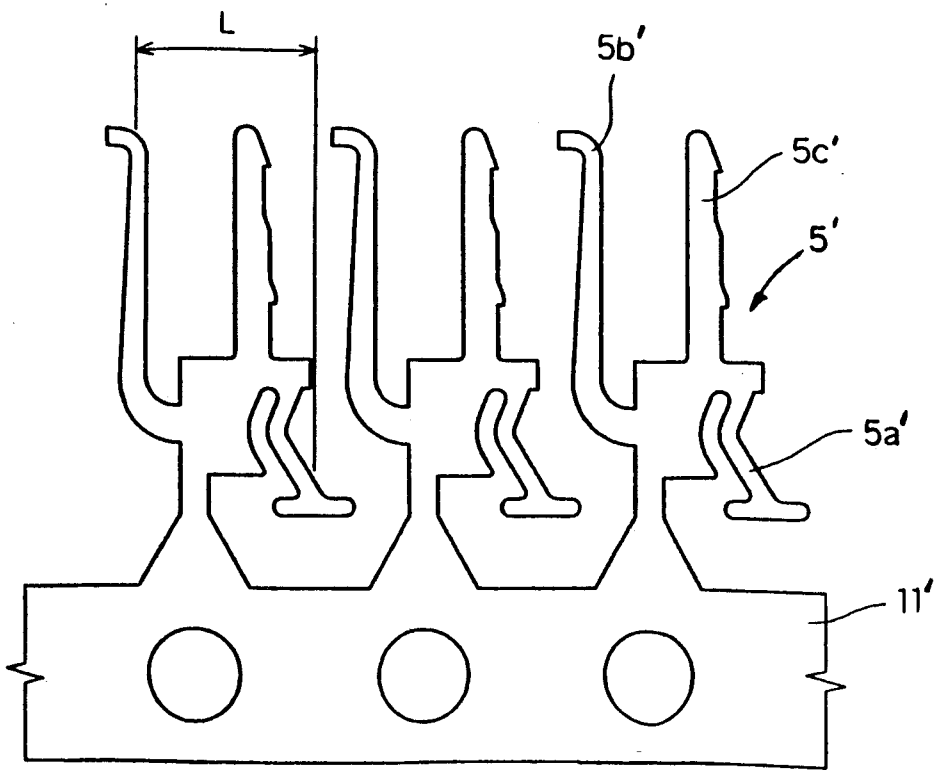
FIG. 7 (PRIOR ART)
FIG. 7 is a contiguous series of prior art female terminals prior to separation from the longitudinal carrier strip.
Figure 6:
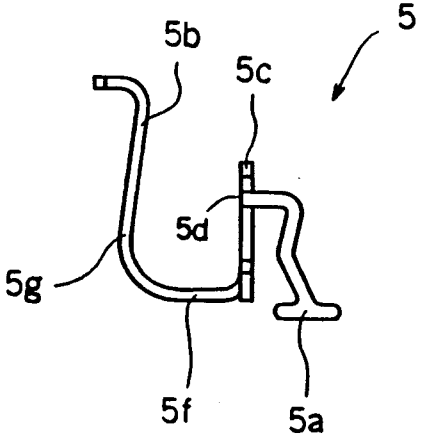
FIG. 6 is a side view of the female terminal.

The female terminal 5 has a T-shaped soldering foot 5*a* on one side and a contact section 5*b* contacting a mating male terminal 6 on the other side. A mounting section 5*c* integrally connected both to the T-shaped soldering foot 5*a* and the contact section 5*b* enables female terminal 5 to be mounted in the female terminal housing 1. FIG. 3 shows a contiguous series of female terminals 5 punched out from a metal strip leaving one end of each female terminal integrally connected with longitudinal carrier strip 11. In FIG. 3, the die-cut surfaces of each punched female terminal 5 are indicated by 5*g* whereas the major planes of each punched female terminal 5 are indicated by 5*e*. The center-to-center distance between adjacent female terminals is selected to be equal to two times the interval at which female terminals 5 are mounted (2P). The lateral distance from T-shaped soldering foot 5*a* to the contact section 5*b* is indicated by "l".

A contiguous series of female terminals are formed by bending every T-shaped soldering foot 5*a* at 5*d* in a direction which is perpendicular to the major plane 5*e* of mounting section 5*c* (See FIG. 4); and by bending and forming every contact section 5*b* in the direction which is opposite to the direction in which T-shaped soldering foot 5*a* is bent. Contact section 5*b* is formed into a "U"-shape facing the other major surface of mounting section 5*c*, and the horizontal length 5*f* of the "U"-shape section is relatively long. The horizontal length 5*f* and consecutive vertical rise has the effect of providing contact section 5*b* with resiliency.

The male terminal 6' which is to be inserted into a selected insertion slot in a male housing 2, has a soldering leg 6*a* and contact section 6*b*, which will contact the corresponding contact section 5*b* of the mating female terminal 5.

As described earlier, a consecutive series of female terminals are formed by bending the T-shaped soldering foot 5*a* of each female terminal shape in a first direction perpendicular to its major surface and by bending contact section 5*g* in a second direction which is opposite to the first direction. The female terminals thus bent and integrally connected to the longitudinal carrier strip 11 are arranged longitudinally at an interval of 2P, that is, at double the interval at which the insertion slots 3 are arranged in the female terminal housing 1.

The consecutive series of the formed female terminals may be inserted in the insertion slots 3 of the female housing 1 simultaneously. In this particular embodiment, the female terminals 5 are arranged at an interval of 2P, and therefore, each female terminal 5, integrally connected to the longitudinal carrier strip 1!, is inserted in every other insertion slot 3 with its mounting section 5*c* fitted in every other mounting section holder of the female housing 1. Thereafter, another consecutive series of similarly formed female terminals arranged at an interval of 2P and integrally connected to the longitudinal carrier strip 11, may be simultaneously inserted in the remaining insertion slots 3 of the female housing Every female terminal 5 locks itself in the insertion slot 3 within its housing 1. Thus, the female terminals 5 may be quickly mounted in the insertion slots of the female housing. Finally, the female terminals 5 are cut and separated from the longitudinal carrier strip 11.

When the male terminals 6 of the male terminal housing 2 are inserted into the female terminals 5 of the female terminal housing 1, the female terminals 5 contact the male terminals 6 by their major surface planes 5*b*, establishing good electrical connections therebetween.

What is claimed is:

1. A female terminal adapted for mounting in a housing of an electrical connector, the terminal comprising:

a T-shaped foot for soldering the terminal to a printed circuit board, a contact section for engaging a mating male terminal, a mounting section, integrally connected with the T-shaped foot and the contact section, for mounting the terminal in the housing, wherein the terminal is stamped out from a flat metal strip, the stamped out terminal having a first and second opposite major sections, and wherein the T-shaped foot is bent substantially perpendicular to the first major surface of the mounting section and the contact section is formed such that it faces the second major surface of the mounting section.

2. A female terminal in accordance with claim 1, wherein the contact section is attached to the metal strip during the stamping and forming operations.

3. A female terminal in accordance with claim 1, wherein a plurality of female terminals are stamped out and formed from the flat metal strip.

4. A female terminal in accordance with claim 1, wherein the contact section is formed into a substantially "U" shape.

5. A female terminal in accordance with claim 4, wherein the female terminal is mounted in the connector housing while still attached to the metal strip.

6. A female terminal for insertion into a selected insertion slot of a female terminal housing of an electric connector, comprising a T-shaped soldering foot, a contact section for contacting a mating male terminal, a mounting section integrally connected to said T-shaped soldering foot said contact section enabling said female terminal to lock itself in said female terminal housing, characterized in that said female terminal has a shape in that said T-shaped soldering foot, said contact section and said mounting section are integrally connected and stamped out from a metal strip, said contact section and said mounting section being linearly contiguous, said T-shaped soldering foot extending from said mounting section, and wherein said female terminal has said T-shaped soldering foot bent perpendicular to one major surface of said mounting section, and said contact section formed to face the other major surface of said mounting section.

7. A female terminal according to claim 6 wherein said contact section has a "U"-shape to face the other major surface of said mounting section, the horizontal length of said "U"-shaped curve being relatively long.

8. A female terminal according to claim 6 wherein said mating male terminal with which said contact section is to be put in contact, is soldered to a given printed circuit board.

9. A female terminal according to claim 6 wherein said mating male terminal with which said contact section is to be put in contact, is soldered to a given conductor.

* * * * *